US010246981B2

(12) United States Patent
Li

(10) Patent No.: US 10,246,981 B2
(45) Date of Patent: Apr. 2, 2019

(54) FLUID INJECTION PROCESS FOR HYDROCARBON RECOVERY FROM A SUBSURFACE FORMATION

(71) Applicant: Statoil Gulf Services LLC, Houston, TX (US)

(72) Inventor: Huina Li, Houston, TX (US)

(73) Assignee: Statoil Gulf Services LLC, Houston, TX (US)

( * ) Notice: Subject to any disclaimer, the term of this patent is extended or adjusted under 35 U.S.C. 154(b) by 201 days.

(21) Appl. No.: 15/273,913

(22) Filed: Sep. 23, 2016

(65) Prior Publication Data

US 2018/0087362 A1 Mar. 29, 2018

(51) Int. Cl.

| | |
|---|---|
| ***E21B 43/26*** | (2006.01) |
| ***E21B 43/14*** | (2006.01) |
| ***E21B 43/16*** | (2006.01) |
| ***E21B 43/20*** | (2006.01) |
| ***E21B 43/267*** | (2006.01) |

(52) U.S. Cl.

CPC ..... *E21B 43/26* (2013.01); *E21B 43/14* (2013.01); *E21B 43/164* (2013.01); *E21B 43/168* (2013.01); *E21B 43/20* (2013.01); *E21B 43/267* (2013.01)

(58) Field of Classification Search

CPC ..... E21B 43/26; E21B 43/267; E21B 43/14; E21B 43/168; E21B 43/164; E21B 43/20

See application file for complete search history.

(56) References Cited

U.S. PATENT DOCUMENTS

| | | | |
|---|---|---|---|
| 5,411,094 | A | 5/1995 | Northrop |
| 5,607,016 | A | 3/1997 | Butler |
| 6,119,776 | A | 9/2000 | Graham et al. |
| 2003/0051873 | A1 | 3/2003 | Patzek et al. |
| 2006/0118305 | A1 | 6/2006 | East et al. |
| 2009/0062153 | A1 | 3/2009 | Gray et al. |

(Continued)

FOREIGN PATENT DOCUMENTS

| | | |
|---|---|---|
| CA | 2866274 | 3/2016 |
| CA | 2920201 | 4/2016 |

(Continued)

*Primary Examiner* — Brad Harcourt

(74) *Attorney, Agent, or Firm* — Meyertons, Hood, Kivlin, Kowert & Goetzel, P.C.

(57) ABSTRACT

A method of treating a subsurface formation with low permeability to increase total oil production from the formation is disclosed. The method may include providing a first fluid into two or more fractures emanating from a first wellbore. The first fluid may form additional fractures in the formation. The first fluid may also increase a minimum horizontal stress in zones substantially surrounding the fractures emanating from the first wellbore and the additional fractures formed. A zone having a lower minimum horizontal stress may be located between these zones. Additional fractures may be formed from a second wellbore in the formation with at least one of the additional fractures emanating from the second wellbore and propagating into the lower minimum horizontal stress zone. Hydrocarbons may be produced from the first wellbore and/or the second wellbore. A second fluid may be provided into the first wellbore after producing the hydrocarbons from the first wellbore.

24 Claims, 7 Drawing Sheets

(56) References Cited

U.S. PATENT DOCUMENTS

| | | | |
|---|---|---|---|
| 2009/0188669 | A1 | 7/2009 | Berg |
| 2009/0308609 | A1 | 12/2009 | Curole et al. |
| 2010/0096129 | A1 | 4/2010 | Hinkel et al. |
| 2010/0224361 | A1 | 9/2010 | Pope et al. |
| 2010/0270021 | A1 | 10/2010 | Baran, Jr. et al. |
| 2010/0276149 | A1 | 11/2010 | Pope et al. |
| 2010/0288498 | A1 | 11/2010 | Moore et al. |
| 2010/0307759 | A1 | 12/2010 | Berg et al. |
| 2011/0042083 | A1 | 2/2011 | Sierra et al. |
| 2011/0287983 | A1 | 11/2011 | Ali et al. |
| 2011/0287984 | A1 | 11/2011 | Mirakyan et al. |
| 2012/0285693 | A1 | 11/2012 | Mirakyan et al. |
| 2013/0048279 | A1 | 2/2013 | Appel et al. |
| 2013/0087325 | A1 | 4/2013 | Bartko et al. |
| 2013/0228337 | A1 | 9/2013 | Dombrowski et al. |
| 2014/0000886 | A1 | 1/2014 | Milam et al. |
| 2014/0014330 | A1 | 1/2014 | Dams et al. |
| 2014/0262239 | A1 | 9/2014 | Keller et al. |
| 2014/0262240 | A1 | 9/2014 | Boone et al. |
| 2014/0332212 | A1 | 11/2014 | Ayers et al. |
| 2015/0096756 | A1 | 4/2015 | Sharma et al. |
| 2015/0167437 | A1 | 6/2015 | Dawson |
| 2015/0329766 | A1 | 11/2015 | Dams et al. |
| 2015/0345268 | A1 | 12/2015 | Bryant et al. |
| 2015/0369023 | A1 | 12/2015 | MacPhail et al. |
| 2016/0003017 | A1 | 1/2016 | Keller et al. |
| 2016/0053163 | A1 | 2/2016 | Nguyen et al. |
| 2016/0230526 | A1* | 8/2016 | Crews ..... E21B 43/17 |
| 2016/0251568 | A1* | 9/2016 | Do ..... C09K 8/584 166/270.1 |

FOREIGN PATENT DOCUMENTS

| | | |
|---|---|---|
| WO | 2015061342 | 4/2015 |
| WO | 2015105513 | 7/2015 |
| WO | 2015191864 | 12/2015 |

* cited by examiner

FLUID INJECTION PROCESS FOR HYDROCARBON RECOVERY FROM A SUBSURFACE FORMATION

BACKGROUND

1. Technical Field

Embodiments described herein relate to systems and methods for subsurface wellbore completion and subsurface reservoir technology. More particularly, embodiments described herein relate to systems and methods for treating subsurface oil-bearing formations and hydrocarbon recovery from such formations.

2. Description of Related Art

Secondary hydrocarbon recovery methods such as waterflood and/or gas flood are widely used for conventional oil resources. Applying secondary hydrocarbon recovery methods to ultra-tight-oil-bearing formations, however, presents significant challenges. Ultra-tight oil-bearing formations (e.g., oil-bearing resources) may have ultra-low permeability that is orders of magnitude lower than conventional resources. Examples of ultra-tight oil-bearing formations include, but are not limited to, the Bakken formation, the Permian Basin, and the Eagle Ford formation. These ultra-tight oil-bearing formations are often stimulated using hydraulic fracturing techniques to enhance oil production. Long (or ultra-long) horizontal wells may be used to enhance production from these resources and provide production suitable for commercial production.

Hydraulic fracturing operations include injection of fracturing fluids that include water into the subterranean formation (e.g., the shale formation) at high pressure to create "cracks" in the rock. These cracks provide a large surface area to assist in hydrocarbon recovery. The fracturing fluids may include at least some solid particles (e.g., "proppants") that typically make up 5-15% by volume of the fracturing fluid. Proppants are injected into the formation to keep fractures open and conductive to allow hydrocarbons to be continuously recovered from the formation.

To optimize fracturing performance, a wide variety of chemicals are often added (typically in a low volume percent of less than 1%) to the fracturing fluids. These chemicals may reduce friction pressure associated with high-rate injection, increase the viscosity to facilitate proppant transport, reduce interfacial tension between oil and water to assist in water flowback, and/or mitigate risk associated with formation damage. Examples of these chemicals include, but are not limited to, reducing agents, gelling agents, crosslinkers, surfactants, biocide, corrosion inhibitor, scale inhibitor, and biocide. While water is typically used fluid in a fracturing process, nitrogen, carbon dioxide, propane, liquid petroleum gas, and natural gas have been used as alternative fracturing fluids. These fluids may offer advantages over water, especially in sensitive formations where water may cause formation damage due to clay swelling and/or fine migration.

Hydraulic fracturing has enabled some successful development of ultra-tight oil-bearing formations such as shale formations. Primary recovery for these resources, however, often only recovers 5-15% of the original oil-in-place under primary depletion. Additionally, hydrocarbon production rate from fractured reservoirs often declines sharply after primary depletion due to the ultra-low permeability of the shale resource. For example, the oil production rate may decrease between about 60% and about 90% after a year with the production rate being expected to sharply decline in subsequent years and eventually stabilize at a much lower rate compared to the initial production rate.

The low primary recovery in ultra-tight-oil-bearing formations may be due to the ultra-low permeability of these formations and mixed to oil-wet characteristics. The ultra-low permeability may cause water or gas injection into these formations to be a slow process, which makes hydrocarbon recovery inefficient. The slow process may result in increased recovery taking prohibitively long and/or being almost impossible to achieve. Ultra-tight-oil-bearing formations may, in some cases, be characterized as being mixed to oil-wet systems. In the mixed to oil-wet systems, oil has a strong tendency to adhere to the reservoir rock, which may reduce waterflood efficiency.

Because of the low primary recovery from ultra-tight-oil-bearing formations and the sharp decline in production after primary depletion, there are opportunities to increase the percentage of oil recovered from these resources. In recent years, there has been development of secondary recovery methods in order to attempt to maintain higher production rates in ultra-tight oil-bearing formations such as shale resources. Examples of secondary recovery methods include refracturing, same-well frac-to-frac flooding, and well-to-well flooding. Refracturing is the process of hydraulic fracturing a well after the initial fracturing operation and production phase. In refracturing, fluids are injected at a higher pressure above the fracturing pressure required to create new fractures. Effective refracturing operations may significantly improve production from previously depleted wells. The combination of existing perforations and a depleted reservoir, however, greatly alters the in situ stress and makes it challenging to design an effective refracturing process that can be applied to multiple wells. While progress has been made to optimize refracturing operations, the cyclic process itself is not able to provide sustainable pressure fronts to mobilize and sweep oil across appreciable distances. Thus, refracturing often has a resulting steep decline similar to the decline after primary depletion.

Waterflood or water injection has been used to improve oil recovery for conventional reservoirs for many decades. Injection of water into a subterranean formation may provide pressure support and energy drive (also known as voidage replacement) required to displace oil and drive the oil towards production wells to increase oil recovery. Over the past few decades, significant improvements have been made to optimize water chemistry and utilize additives such as surfactant polymer to improve pore-level recovery and sweep efficiency. Such process may be referred to as chemical floods. Examples of chemical floods include, but are not limited to, alkali-surfactant-polymer flooding, polymer flooding, surfactant flooding, and low-salinity water injection. In typical chemical floods, the water composition is modified before injection. For example, surfactant may be included to reduce interfacial tension between oil and water and also alter wettability of the rock surface in order to mobilize oil affiliated to the rock surface. In some cases, polymer based gels may be added to block preferential water flow through high permeability zones.

Gas flooding is another technology used to increase oil recovery. In gas flooding, gas may be injected to maintain reservoir pressure. The reservoir pressure may be used as the driving force to displace oil horizontally or vertically in the formation. In addition, injected gas may be able to vaporize the oil component in condensate-rich reservoirs and "swell" the oil in under-saturated reservoirs to reduce oil viscosity and expedite oil flow towards production wells. Gas flooding processes may include technologies such as, but not limited to, $CO_2$ injection, hydrocarbon gas injection, and nitrogen injection. Gas flooding processes often follow water flooding processes and, in some cases, water and gas injection are alternated. Alternating water and gas injection may improve sweep efficiency and mitigate the effects of viscous fingering due to adverse mobility contrast between the gas and the in-situ oil and gravity override due to density contrasts between the gas and the oil. Such alternating processes are sometimes referred to as water alternating gas injection or WAG.

In waterflood and gas flooding processes, injection fluid is injected from a well at a low rate continuously and hydrocarbon is produced from the wells in the vicinity. The injection fluid is expected to be distributed through the fractures to access the rock matrix and form a continuous front to displace oil toward production wells. With this distribution, the oil production rate may be higher due to the pressure support provided by fluid injection and other mechanisms such as reduced oil viscosity or modified wettability to release more oil. Ultra-tight-oil-bearing formations, however, may have fracture networks that are widely distributed. A fracture network may include fractures created through hydraulic fracturing and/or naturally-occurring fractures present prior to fracture stimulation. The fracture network may provide highly permeable conduits for the injected fluid to be transported from injection wells to production wells. These conduits may "short circuit" the flow pathways and the injected fluid may bypass targeted oil-bearing zones. This "breakthrough" process may reduce sweep efficiency of a flooding operation and may limit the applicability of waterflooding or gas flooding to ultra-tight-oil-bearing formations such as shale formations. For example, once the injected fluid is produced from the production well, oil production is suppressed and the amount of the injected fluid needed to be used increases significantly, making the injection operation highly ineffective and, in some cases, making the injection operation come to a halt.

The high-degree of connectivity between injection and production wellbores may be formed through fractures that are naturally occurring but probably more importantly through those created by hydraulic fracturing. In the latter case, the fluid breakthrough is exacerbated due to the fact that an injection well is usually converted from the oldest production well (often known as "acreage-retention" wells) on a given well pad. During the production phase prior to injection, as formation fluids are withdrawn from these "acreage-retention" wells, the minimum horizontal stress is reduced creating a "low-stress" zone that is more prone to fracturing. When new wells are drilled and completed next to an acreage-retention well, fractures propagate preferentially towards the "low-stress" zones and intersect with fractures of the "acreage-retention" well leading to well-connected fracture pathways that channel fluids between wells. There are no known technologies that have successfully addressed this challenge by either preventing or mitigating the connectivity between wells and the resulting fluid breakthrough.

SUMMARY

In certain embodiments, a method of treating a subsurface formation includes providing a first fluid into a first fracture and a second fracture emanating from a first wellbore in the formation. At least some hydrocarbons may have been produced from the formation through the first fracture and the second fracture and through the first wellbore. At least a portion of the first fluid may be provided at a pressure above a fracture pressure of the subsurface formation for at least a period of time to form one or more third fractures. At least a portion of the first fluid may increase a minimum horizontal stress in a first zone of the formation substantially surrounding the first fracture. At least a portion of the first fluid may increase a minimum horizontal stress in a second zone substantially surrounding the second fracture. At least a portion of the first fluid may increase a minimum horizontal stress in a third zone of the formation substantially surrounding at least one of the third fractures. A fourth zone of the formation may be located outside of the first zone, the second zone, and the third zone. The fourth zone may have a minimum horizontal stress below the minimum horizontal stress in the first zone, the minimum horizontal stress in the second zone, and the minimum horizontal stress in the third zone after the first fluid increases the minimum horizontal stresses in the first zone, the second zone, and the third zone. One or more fourth fractures may be formed from a second wellbore in the formation. The second wellbore may be substantially parallel to the first wellbore. At least one of the fourth fractures may emanate from the second wellbore and propagate into the fourth zone of the formation. Hydrocarbons may be produced from the first wellbore. A second fluid may be provided into the first wellbore after producing at least some hydrocarbons from the first wellbore. Hydrocarbons may be produced from the second wellbore after forming the fourth fractures.

In certain embodiments, a method of treating a subsurface formation includes providing a first fluid into a first fracture and a second fracture emanating from a first wellbore in the formation. At least some hydrocarbons may have been produced from the formation through the first fracture and the second fracture and through the first wellbore. At least 25% by weight of the first fluid may be provided at a pressure above a fracture pressure of the subsurface formation for a selected period of time to form a third fracture in the formation. At least a portion of the first fluid may increase a minimum horizontal stress in a first volume of the formation substantially surrounding the first fracture. At least a portion of the first fluid may increase a minimum horizontal stress in a second volume of the formation substantially surrounding the second fracture. At least a portion of the first fluid may increase a minimum horizontal stress in a third volume of the formation substantially surrounding the third fracture. A fourth volume of the formation may be located outside of the first volume, the second volume, and the third volume. The fourth volume may have a minimum horizontal stress below the minimum horizontal stress in the first volume, the minimum horizontal stress in the second volume, and the minimum horizontal stress in the third volume after the first fluid is provided into the first wellbore. One or more fourth fractures may be formed from a second wellbore in the formation. The second wellbore may be substantially parallel to the first wellbore. At least one of the fourth fractures may emanate from the second wellbore and propagate into the fourth volume of the formation. Hydrocarbons may be produced from the first wellbore. A second fluid may be provided into the first wellbore after producing at least some hydrocarbons from the first wellbore. Hydrocarbons may be produced from the second wellbore after forming the fourth fractures.

In some embodiments, hydrocarbons from the second wellbore are produced after providing the second fluid into the first wellbore. In some embodiments, at least one of the third fractures extends towards the second wellbore from the first fracture or the second fracture. The first wellbore may be a substantially horizontal wellbore in the formation. The first wellbore may be positioned in a portion of the subsurface formation with an average matrix permeability of at most about 1 mD. In some embodiments, at least the portion of the first fluid provided at the pressure above the fracture pressure of the formation includes at least about 25% by weight of a total injection volume of the first fluid.

BRIEF DESCRIPTION OF THE DRAWINGS

Features and advantages of the methods and apparatus of the embodiments described in this disclosure will be more fully appreciated by reference to the following detailed description of presently preferred but nonetheless illustrative embodiments in accordance with the embodiments described in this disclosure when taken in conjunction with the accompanying drawings in which.

Figure 1:
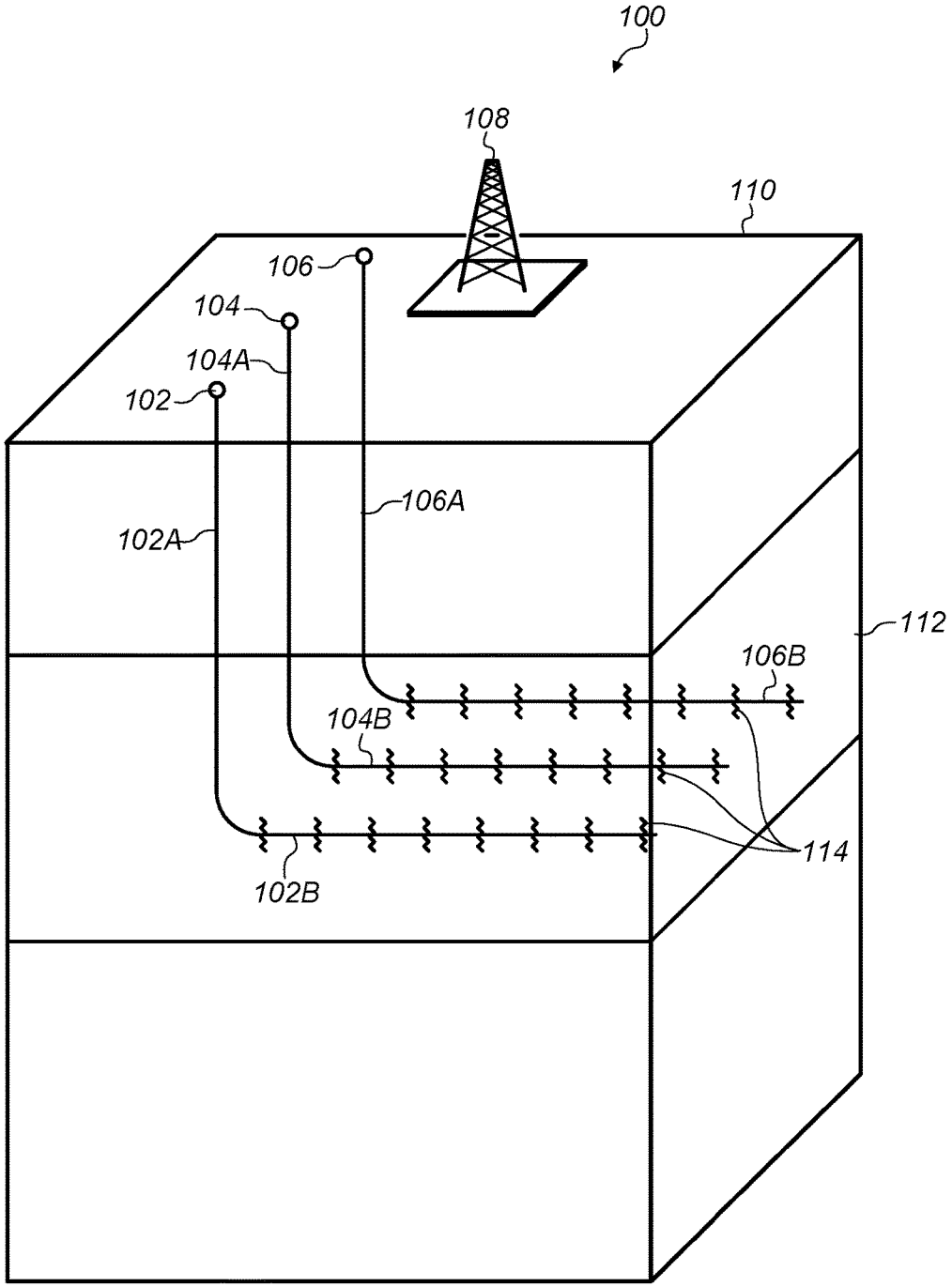
FIG. 1 depicts an example of an embodiment of a drilling operation on a multi-well pad.

While embodiments described in this disclosure may be susceptible to various modifications and alternative forms, specific embodiments thereof are shown by way of example in the drawings and will herein be described in detail. It should be understood, however, that the drawings and detailed description thereto are not intended to limit the embodiments to the particular form disclosed, but on the contrary, the intention is to cover all modifications, equivalents and alternatives falling within the spirit and scope of the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

Fractures in subsurface formations as described herein are directed to fractures created hydraulically. It is to be understood, however, that fractures created by other means (such as thermally or mechanically) may also be treated using the embodiments described herein.

FIG. 1 depicts an example of an embodiment of a drilling operation on a multi-well pad. It is to be understood that the drilling operation shown in FIG. 1 is provided for exemplary purposes only and that a drilling operation suitable for the embodiments described herein may include many different types of drilling operations suitable for hydraulic fracturing of oil-bearing subsurface formations and/or other fracture treatments for such formations. For example, the number of groups of wellbores and/or the number of wellbores in each group are not limited to those shown in FIG. 1. It should also be noted that the wellbores may be, in some cases, be vertical wellbores without horizontal sections.

In certain embodiments, as depicted in FIG. 1, drilling operation 100 includes groups of wellbores 102, 104, 106 drilled by drilling rig 108 from single pad 110. Wellbores 102, 104, 106 may have vertical sections 102A, 104A, 106A that extend from the surface of the earth until reaching oil-bearing subsurface formation 112. In formation 112, wellbores 102, 104, 106 may include horizontal sections 102B, 104B, 106B that extend horizontally from vertical sections 102A, 104A, 106A into formation 112. Horizontal sections 102B, 104B, 106B may increase or maximize the efficiency of oil recovery from formation 112. In certain embodiments, formation 112 is hydraulically stimulated using conventional hydraulic fracturing methods. Hydraulic stimulation may create fractures 114 in formation 112. It is to be understood that while FIG. 1 illustrates that several groups of wellbores 102, 104, 106 reach the same formation 112, this is provided for exemplary purposes only and, in some embodiments, the groups and the wellbores in different groups can be in different formations. For example, the groups and the wellbores may be in two different formations.

Figure 2:
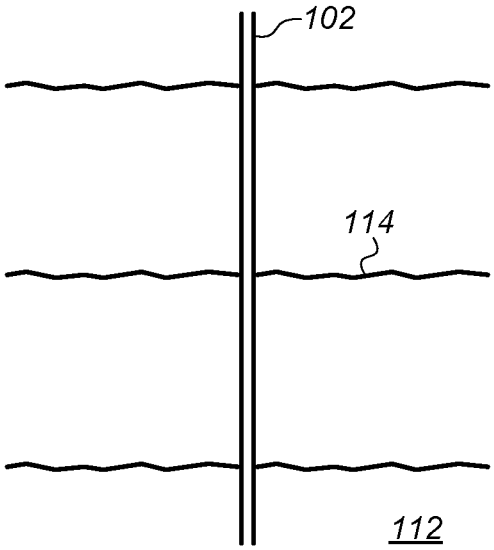
FIG. 2 depicts a plane view representation of an embodiment of a wellbore in a formation.

FIG. 2 depicts a plane view representation of an embodiment of wellbore 102 in formation 112. In certain embodiments, formation 112 is an ultra-low permeability formation. For example, formation 112 may have an initial (before treatment) average matrix permeability of at most about 1 mD. In some embodiments, formation 112 has an initial average matrix permeability of at most about 10 mD or at most about 25 mD. In some embodiments, formation 112 is a shale formation.

In certain embodiments, wellbore 102 is a horizontal or relatively horizontal wellbore in formation 112. A plurality of fractures 114 may be formed from wellbore 102. In certain embodiments, fractures 114 are induced or stimulated using fluids provided (e.g., injected) into wellbore 102. For example, fractures 114 may be formed by hydraulic fracturing from wellbore 102. In some embodiments, as depicted in FIG. 2, fractures 114 are formed substantially perpendicular to wellbore 102. It is to be understood, however, that fractures 114 may be formed at a variety of angles relative to wellbore 102. For example, the angle of fractures 114 may depend on properties and/or conditions of formation 112 during formation of the fractures.

In certain embodiments, after fractures 114 are formed, formation fluids are produced from formation 112 through fractures 114 and wellbore 102. Formation fluids produced from formation 112 may include hydrocarbons from the formation. Such production of formation fluids may be primary recovery from formation 112. Primary recovery may be performed until production rates of hydrocarbons from formation 112 reach selected levels such as, but not limited to, non-viable levels (e.g., production rates that are not commercially viable). After primary recovery is stopped, a volume of formation fluids has been produced from formation 112 through wellbore 102. In some embodiments, the volume of formation fluids produced through wellbore 102 is at least about 10,000 bbl. In some embodiments, the volume of formation fluids produced through wellbore 102 is at least about 15,000 bbl or at least about 20,000 bbl.

Figure 3:
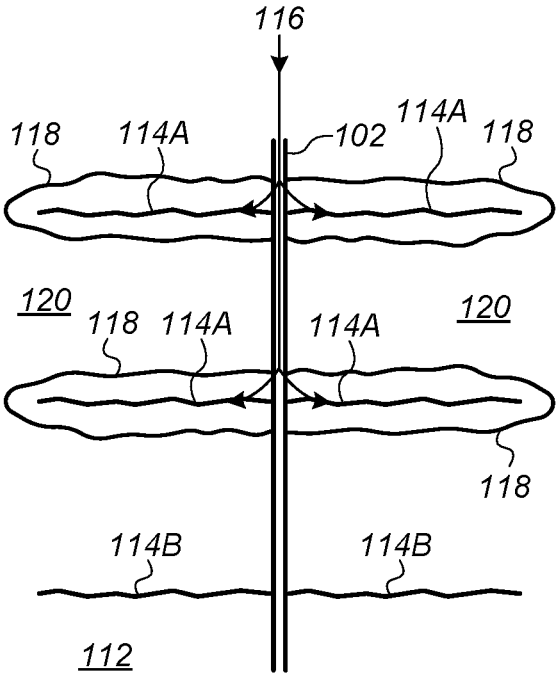
FIG. 3 depicts a plane view representation of an embodiment of a fluid being provided into fractures emanating from a wellbore in a formation.

In certain embodiments, after production through wellbore 102 is stopped and the volume of formation fluids has been produced through the wellbore, a fluid is provided (e.g., injected) into two or more fractures 114 emanating from the wellbore to increase pressure in and around the fractures. FIG. 3 depicts a plane view representation of an embodiment of fluid 116 being provided into fractures 114 emanating from wellbore 102 in formation 112. Fluid 116 may be provided into fractures 114 by injecting the fluid into wellbore 102. In some embodiments, fluid 116 is injected continuously into wellbore 102. In some embodiment, injection of fluid 116 into wellbore 102 is cyclic or alternated between different fractures 114.

In certain embodiments, fluid 116 is water or mostly water. For example, in certain embodiments, fluid 116 is at least about 95% by weight water. In some embodiments, fluid 116 is at least about 90% by weight water or at least about 80% by weight water. In some embodiments, fluid 116 includes one or more additives (e.g., in addition to water). For example, fluid 116 may include anionic surfactant, cationic surfactant, zwitterionic surfactant, non-ionic surfactant, or combinations thereof. The additives may enhance flow of fluid 116 through formation 112. In some embodiments, fluid 116 includes a gas or is a gas. For example, fluid 116 may include, or be, carbon dioxide and/or natural gas.

In some embodiments, fluid 116 is only allowed to flow into selected fractures. For example, as shown in FIG. 3, fluid 116 is only allowed to flow into fractures 114A while fluid flow into fractures 114B is inhibited. Flow into certain fractures (e.g., fractures 114B) may be inhibited using, for example, sliding sleeves or other devices that can be positioned along wellbore 102 near the fracture origin to inhibit fluid flow into the fractures. The sliding sleeves or other devices may be moved along the wellbore to allow flow into other fractures as needed.

In certain embodiments, a significant portion of fluid 116 provided into wellbore 102 is provided at a high injection rate. For example, at least about 25% by weight of fluid 116 provided into wellbore 102 may be provided at the high injection rate. The high injection rate for fluid 116 may include injection rates of at least about 30 bbl/min, at least about 40 bbl/min, or at least about 50 bbl/min. In some embodiments, substantially all of fluid 116 is provided at the high injection rate. In some embodiments, a remaining portion of fluid 116 (e.g., the portion of the fluid remaining after the significant portion) is provided at lower injection rates and lower pressures below the fracture pressure of formation 112. The remaining portion of fluid 116 with the lower pressure may be provided prior to, after, or both prior to and after the high injection rate portion such that fluid 116 enters the rock formation driven by pressure gradient and/or imbibition processes.

In certain embodiments, as shown in FIG. 3, providing at least some fluid 116 flow into fractures 114A with the injection pressure at least at the lower injection pressures causes fluid 116 to flow from the fractures into zones 118 around the fractures in formation 112. Zones 118 may be zones, volumes, or areas substantially surrounding fractures 114A. The flow of fluid 116 into zones 118 may increase the pressure and/or the minimum horizontal stress in these zones. Thus, zones 118 may be zones created by injection of fluid 116 that have higher pressures (or minimum horizontal stresses) than other zones or portions of the formation.

As shown in FIG. 3, zones 118 may be formed substantially surrounding fractures 114A without overlap between the zones. In certain embodiments, injection of fluid 116 is controlled to inhibit overlapping between zones 118. For example, injection pressure, rate of injection, and/or total injection volume may be selected to form zones 118 substantially surrounding fractures 114A without overlapping between the zones and/or causing breakthrough between the zones.

In certain embodiments, without overlap between zones 118, zones 120 are formed between zones 118 in formation 112. In some embodiments, zones 120 are at least partially between zones 118 in formation 112. Zones 120 may have pressures (e.g., pore pressures) that are lower than the pressures in zones 118 caused by injection of fluid 116. In certain embodiments, zones 118 have pressures that are at least about 1000 psi greater than the pressures in zones 120. In some embodiments, zones 118 have pressures at least about 1500 psi, or at least about 2000 psi, greater than pressures in zones 120. In certain embodiments, zones 118 have minimum horizontal stresses that are at least about 500 psi greater than the minimum horizontal stresses in zones 120. In some embodiments, zones 118 have minimum horizontal stresses at least about 750 psi, or at least about 1000 psi, greater than minimum horizontal stresses in zones 120.

In certain embodiments, as described above, a portion of fluid 116 (e.g., the significant portion) is provided at increased or higher pressure while the fluid is provided into wellbore 102. The higher pressure portion of fluid 116 may be provided by increasing the pressure of the portion to a pressure above the fracture pressure of formation 112 (e.g., increasing the pressure of the portion of fluids 116 to a "fracking" pressure sufficient to form fractures in the formation) and/or adding fluid at the increased pressure (e.g., the fracking pressure) to fluid 116 being provided into wellbore 102. In some embodiments, the higher pressure portion of fluid 116 provided into wellbore 102 provides a bottom hole pressure of the fluid at or near a heel of the wellbore (e.g., the transition of the wellbore to horizontal) that is greater than a median minimum horizontal stress in formation 112. The higher pressure portion of fluid 116 may be provided for a period of time to form additional fractures in formation 112.

Figure 4A:
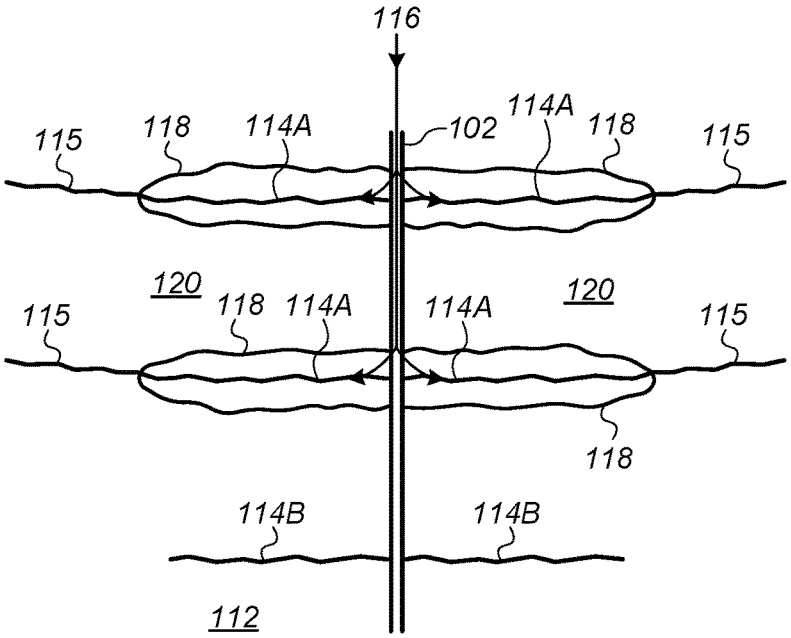
FIGS. 4A and 4B depict plane view representations of embodiments of a fluid being provided into a wellbore to form additional fractures in a formation.
Figure 4B:
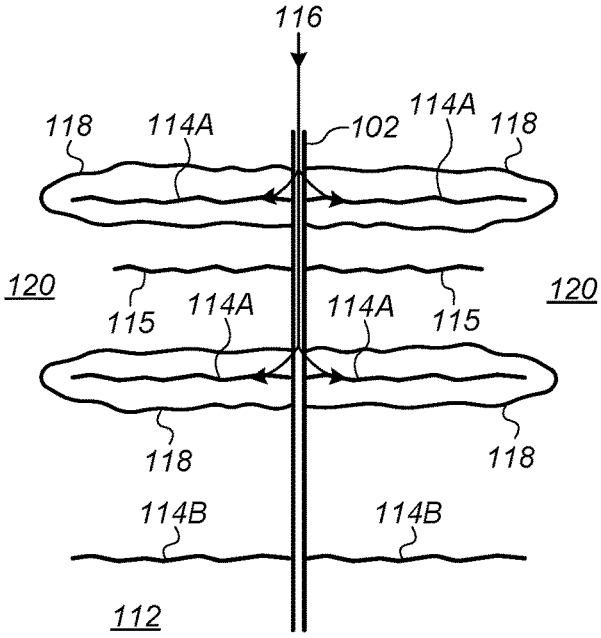

FIGS. 4A and 4B depict plane view representations of embodiments of fluid 116 being provided into wellbore 102 to form additional fractures 115 in formation 112. In some embodiments, as shown in FIG. 4A, fractures 115 extend into formation 112 from fractures 114. Thus, fractures 115 extend further into formation 112 from fractures 114 and fractures 115 access new areas of hydrocarbons in the formation not previously accessed by fractures 114.

In some embodiments, as shown in FIG. 4B, fractures 115 extend into formation 112 from wellbore 102 to access new areas of hydrocarbons in the formation not previously accessed by fractures 114. For example, fractures 115 may extend from new initiation ports on wellbore 102 without intersecting with fractures 114A. The presence of zones 118 may inhibit fractures 115 from intersecting with fractures 114A. In some embodiments, a diverter material and/or a plugging agent may be intermittently added to fluid 116 to form fractures 115 from new initiation ports on wellbore 102 (and/or fractures 114A, shown in FIG. 4A). The new initiation ports may be existing perforations not activated and/or new perforations along wellbore 102.

While fractures 115 are depicted, in FIG. 4A, as propagating at a small angle from fractures 114A and, in FIG. 4B, as propagating substantially perpendicular to wellbore 102, it is to be understood that fractures 115 may propagate at a variety of angles from fractures 114A and/or wellbore 102. For example, fractures 115 may propagate along substantially the same horizontal line as fractures 114A and/or at an angle from wellbore 102. In addition, while fractures 115 are shown in one embodiment as extending from existing fractures 114 and in another embodiment as extending from wellbore 102, it is to be understood that some embodiments may include fractures 115 extending from both existing fractures 114 and wellbore 102.

In certain embodiments, the portion of fluid 116 (e.g., the significant portion) provided at the increased (higher) pressure to form fractures 115, shown in FIGS. 4A and 4B, is a selected amount of fluid 116 (e.g., fluid 116 includes a selected amount of fluid with a pressure above the fracture pressure of formation 112). In some embodiments, the portion of fluid 116 provided at the increased pressure (e.g., the portion that has a pressure above the fracture pressure of formation 112) is at least about 25% by weight of the total injection volume of fluid 116. In some embodiments, the portion of fluid 116 provided at the increased pressure is at least about 50% by weight or at least about 75% of the total injection volume of fluid 116. The portion of fluid 116 provided at the increased pressure may be provided at a bottom hole pressure at or near a heel of the wellbore that is greater than the median minimum horizontal stress in formation 112, as described above.

In certain embodiments, providing fluid 116 to form fractures 115 increases a total injection volume of the fluid used in formation 112. For example, the total injection volume of fluid 116 used to form fractures 115 may be between about 5% and about 200% of the total volume of formation fluids removed from formation 112 during production through wellbore 102 before providing the fluid into the wellbore. In some embodiments, the total injection volume of fluid 116 used to form fractures 115 varies from a minimum of about 10% or about 20% to a maximum of about 150% or about 200% of the total volume of formation fluids removed from formation 112 during production through wellbore 102 before providing the fluid into the wellbore.

In some embodiments, one or more proppants are added to fluid 116 when the pressure is increased to form fractures 115 in formation 112. Proppants may be added to fluid 116 to keep fractures 115 open after the fractures are formed. Proppants may also keep fractures 114 from closing during formation of fractures 115. Examples of proppants include, but are not limited to, nut shells, resin-coated nut shells, graded sand, resin-coated sand, sintered bauxite, particulate ceramic materials, glass beads, and particulate polymeric materials.

Figure 5A:
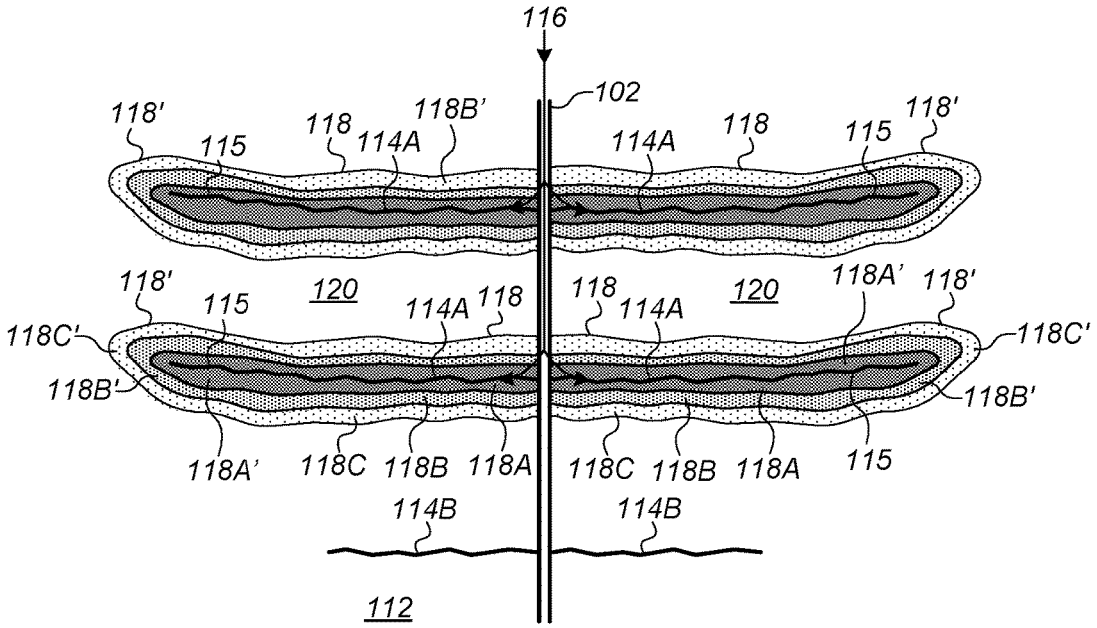
FIGS. 5A and 5B depict plane view representations of embodiments of zones formed around additional fractures in a formation.
Figure 5B:
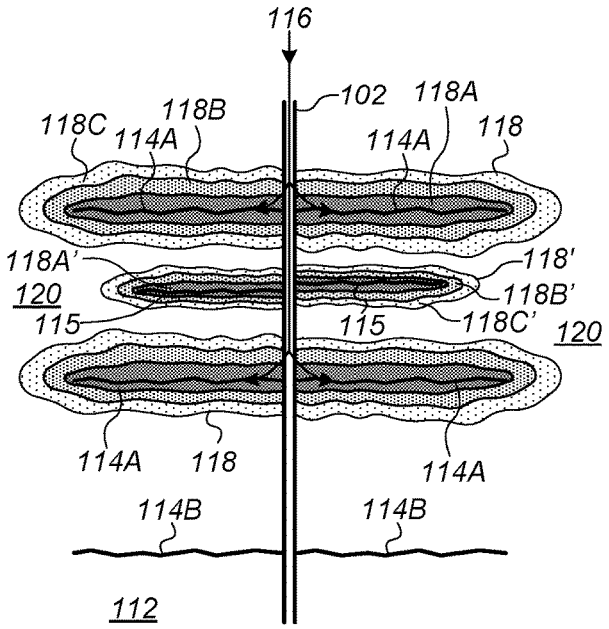

As shown in FIGS. 4A and 4B, fractures 115 may extend into areas of formation 112 that are outside zones 118. For example, as shown in FIG. 4A, fractures 115 may extend beyond zones 118. As shown in FIG. 4B, fractures 115 may be between zones 118. After fractures 115 are formed and fluid 116 flows into formation 112 through fractures 115, however, zones 118' may form around fractures 115, as shown in FIGS. 5A and 5B. FIG. 5A depicts zones 118' formed around fractures 115 extending from fractures 114A (as depicted in the embodiment of FIG. 4A). Thus, as shown in FIG. 5A, zones 118' may be zones, volumes, or areas that are extensions of zones 118 that substantially surround fractures 115. FIG. 5B depicts zones 118' formed around fractures 115 extending from wellbore 102 (as depicted in the embodiment of FIG. 4B). Thus, as shown in FIG. 5B, zones 118' may be zones, volumes, or areas extending from wellbore 102 that substantially surround fractures 115.

In some embodiments, as shown in FIGS. 5A and 5B, zones 118' are formed by continuing to provide fluid 116 into the wellbore at substantially the same pressures used to form fractures 115. In some embodiments, the pressure of fluid 116 may be reduced after fractures 115 are formed and while zones 118' are being formed around the fractures. For example, an average pressure of fluid 116 may be reduced after fractures 115 are formed by decreasing the pressure of the portion of the fluid increased to form fractures 115.

Pressure distribution in zones 118 and zones 118' around fractures 114A and fractures 115 after injection of fluid 116 are depicted by the patterning shown in FIGS. 5A and 5B. The patterning shown in FIGS. 5A and 5B depicts sub-zones 118A, 118B, and 118C and sub-zones 118A', 118B', and 118C' in zones 118 and zones 118', respectively. The pressure distributions shown in FIGS. 5A and 5B provide a representation of minimum horizontal stress distribution in formation 112 after injection of fluid 116 into fractures 114A and fractures 115. As shown in FIG. 5A, the pressure distribution along the fractures may be substantially continuous between zones 118 and zones 118'. As shown in FIG. 5B, zones 118 and zones 118' are separated (e.g., do not intersect) but may have substantially similar pressure distributions along the fractures.

As shown in FIGS. 5A and 5B, minimum horizontal stresses in zones 118 and zones 118' in and around fractures 114A and fractures 115 are higher than the more distant parts of formation 112 (e.g., zone 120 formed between zones 118 and zones 118'). More specifically, pressures may be higher along fractures 114A, fractures 115, and nearer wellbore 102 in sub-zones 118A, 118B, and 118C and sub-zones 118A', 118B', and 118C' due to the injection of fluid 116 going through the fractures from the wellbore. Typically, pressure decreases as the distance from fractures 114A, fractures 115, and wellbore 102 increases. For example, as shown in FIG. 5A, pressures in zones 118 and 118' may be highest in sub-zones 118A and 118' and lowest in sub-zones 118C and 118C' with sub-zones 118B and 118B' having pressures in between the other sub-zones. With the increased pressure in zones 118 and zones 118', these zones form "stress shields" around fractures 114A and fractures 115.

Zones 118' may either extend from zones 118 without overlap between the zones, as shown in FIG. 5A, and/or zones 118' may extend from wellbore 102 without overlap between zones 118' and zones 118, as shown in FIG. 5B. Thus, as zones 118' are formed, zones 120 may change in size and/or structure. As shown in FIG. 5A, zones 120 may increase in size (e.g., volume) as zones 120 now include zone or volume between both zones 118 and zones 118'. As shown in FIG. 5B, zones 120 may decrease somewhat in size due to the presence of zones 118' between zones 118. In certain embodiments, injection of fluid 116 is controlled to inhibit overlapping between zones 118' and zones 118. For example, injection pressure, rate of injection, and/or total injection volume may be selected to form zones 118' substantially surrounding fractures 115 without overlapping between the zones and/or breakthrough between the zones.

As described above for FIGS. 4A, 4B, 5A, and 5B, fractures 115 and zones 118' may be formed by increasing the pressure of at least a portion of fluid 116 while the fluid is being provided into wellbore 102. In some embodiments, the portion of fluid 116 at the higher pressure (e.g., above the fracture pressure) may form fractures 115 as zones 118 are being formed. Zones 118' may be formed after fractures 115 are formed as fractures 115 are needed to allow fluid 116 to flow into formation 112 around fractures 115. Portions of zones 118', however, may form as fractures 115 are being formed (e.g., zones 118' may form around portions of fractures 115 closer to wellbore 102 before portions of fractures 115 further from the wellbore are formed).

Figure 6A:
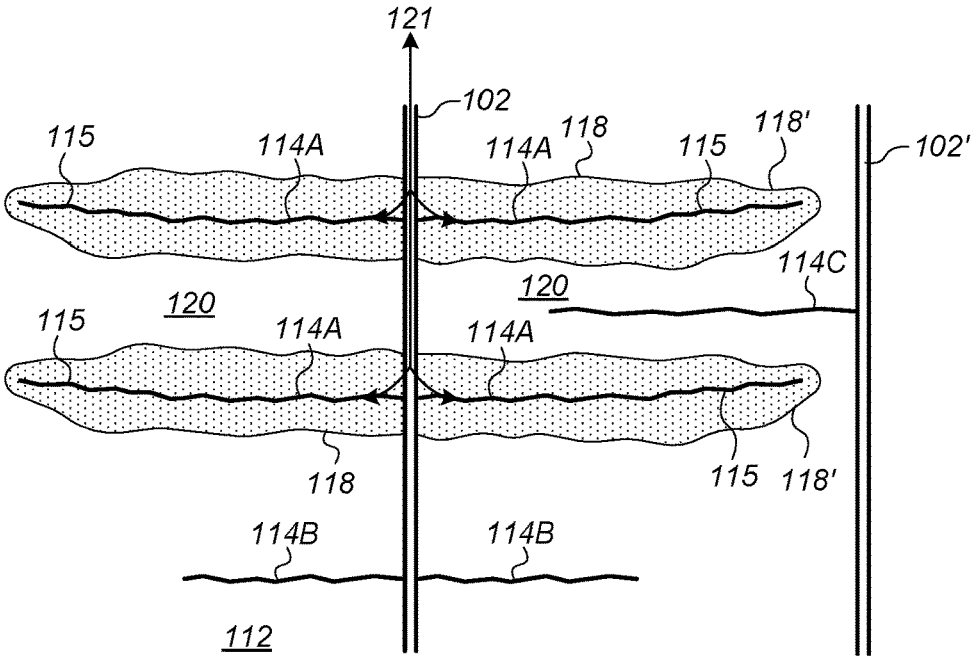
FIGS. 6A and 6B depict plane view representations of embodiments of a second wellbore positioned along with a wellbore in a formation.
Figure 6B:
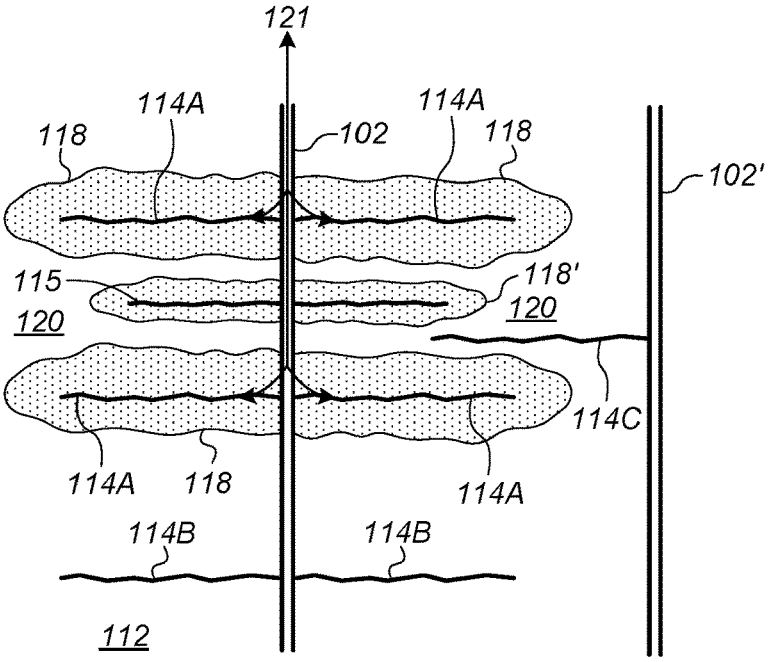

In certain embodiments, a second wellbore positioned in formation 112 is used to stimulate fractures in the formation after zones 118, fractures 115, and zones 118' are formed in the formation. FIG. 6A depicts a plane view representation of an embodiment of second wellbore 102' positioned along with wellbore 102 in formation 112 for the embodiment of fractures 115 and zones 118' depicted in FIG. 5A. FIG. 6B depicts a plane view representation of an embodiment of second wellbore 102' positioned along with wellbore 102 in formation 112 for the embodiment of fractures 115 and zones 118' depicted in FIG. 5B. In certain embodiments, as shown in FIGS. 6A and 6B, second wellbore 102' is substantially parallel to wellbore 102 in formation 112. Second wellbore 102' and wellbore 102 may be at substantially the same depth in formation 112.

In certain embodiments, second wellbore 102' is formed in formation 112 after fluid 116 is injected into wellbore 102. In some embodiments, second wellbore 102' is formed during injection of fluid 116 into wellbore 102. Second wellbore 102' may, however, also be formed at any time before fluid 116 is injected into wellbore 102. For example, second wellbore 102' may be formed at or near the same time as wellbore 102.

In certain embodiments, fractures 114C are formed (e.g., stimulated) in formation 112 using second wellbore 102', as shown in FIGS. 6A and 6B. Fractures 114C may be formed using stimulation methods known in the art. For example, fractures 114C may be formed using fracturing fluids. In some embodiments, the fracturing fluids include friction reducers, gelled aqueous fluids, foam, or combinations thereof. In certain embodiments, fractures 114C are formed after injection of fluid 116, shown in FIGS. 3-5B, is stopped or halted. In some embodiments, the formation of fractures 114C is delayed for a period of time after stopping the injection of fluid 116 to allow fluid 116 to reside in formation 112 for the period of time.

In some embodiments, at least some formation fluids are produced from second wellbore 102' after formation of fractures 114C. Production of at least some formation fluids from second wellbore 102' may occur before, during, and/or after production of formation fluids 121 from wellbore 102 (described below). Producing through second wellbore 102' may produce some formation fluids from areas around fractures 114C in formation 112. In some embodiments, formation fluids are not produced from second wellbore 102' until after production through wellbore 102 is stopped and a second fluid is provided into wellbore 102 (described below).

In certain embodiments, as shown in FIGS. 6A and 6B, at least one fracture 114C emanates from second wellbore 102' and propagates into zone 120. Fracture 114C may preferentially propagate into zone 120 due to the reduced minimum horizontal stress in zone 120 as compared to zones 118 and zones 118'. While fracture 114C propagating into zone 120 is depicted in FIGS. 6 and 6B as propagating at a substantially perpendicular angle from second wellbore 102', it is to be understood that fracture 114C may propagate at a variety of angles from the second wellbore. Regardless of the angle of propagation, however, such a fracture may still preferentially propagate into zone 120 due to the reduced minimum horizontal stress in zone 120 as compared to zones 118 and zones 118'. Additionally, while fracture 114C is shown propagating into one portion of zone 120 between the bottom zone 118 and zone 118' in FIG. 6B, it is to be understood that fracture 114C may propagate into any portion of zone 120 as long as the fracture propagates into zone 120. For example, fracture 114C may propagate into a portion of zone 120 between the top zone 118 and zone 118'.

As fracture 114C preferentially propagates into zone 120, fracture 114C propagates into the space between fractures 114A inside zones 118 and zones 118', and thus fracture 114C is inhibited from intersecting fractures 114A and/or fractures 115. In certain embodiments, the sizes (or volumes) of zones 118, zones 118', and zone 120 are controlled during injection of fluid 116 (shown in FIGS. 3-6B) to inhibit fracture 114C from intersecting fractures 114A and/or fractures 115 (e.g., the zones are sized to inhibit intersection of the fractures). The size of zones 118, zones 118', and zone 120 may be controlled by controlling the rate of injection of fluid 116, the injection pressure of fluid 116, and/or the total injection volume of fluid 116. Inhibiting fracture 114C from intersecting fractures 114A and/or fractures 115 reduces the likelihood of connectivity between wellbore 102 and second wellbore 102' through a fracture network (e.g., fluid channeling and breakthrough are inhibited between the wellbores).

In certain embodiments, after formation of fractures 114C, formation fluids 121 (e.g., hydrocarbons) are produced through wellbore 102, as shown in FIGS. 6A and 6B. Producing through wellbore 102 produces hydrocarbons accessed in formation 112 by fractures 115. Because fractures 115 extend into formation 112 from fractures 114A and/or extend into the formation from wellbore 102 at different locations (e.g., different initiation ports) than fractures 114A, fractures 115 may provide access to additional areas of formation 112 (e.g., areas around fractures 115) that are not depleted of hydrocarbons (e.g., the area around fractures 114A already produced through wellbore 102). In some embodiments, production of formation fluids 121 through wellbore 102 is started a selected amount of time after fractures 114C are formed from second wellbore 102'. The time between forming fractures 114C and producing formation fluids 121 may be used to allow settling of the fractures before production begins.

Figure 7A:
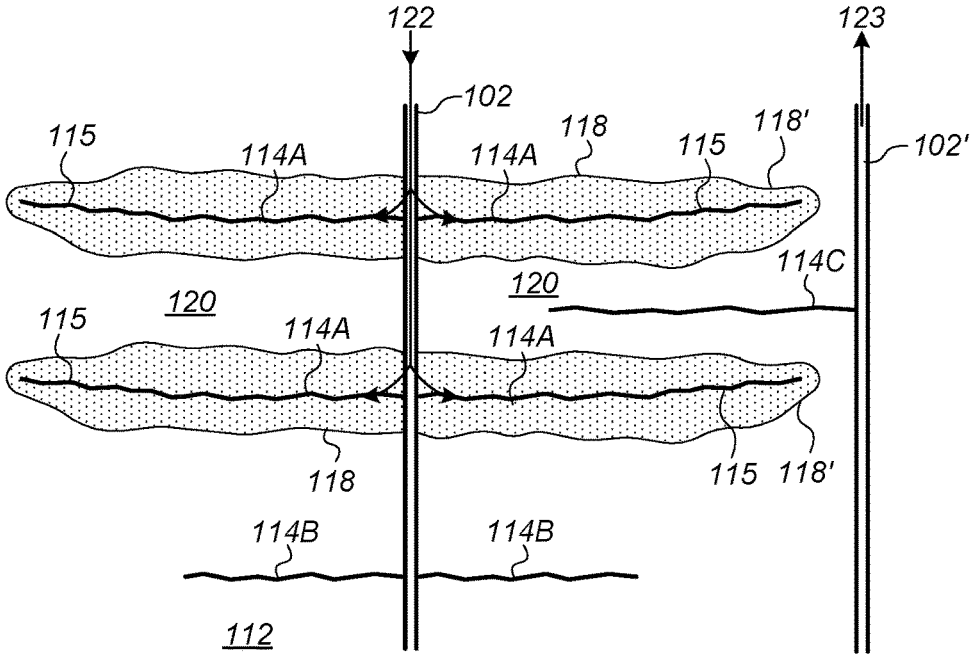
FIGS. 7A and 7B depict plane view representations of embodiments of a second wellbore positioned along with a wellbore in a formation with production of formation fluids from the second wellbore.
Figure 7B:
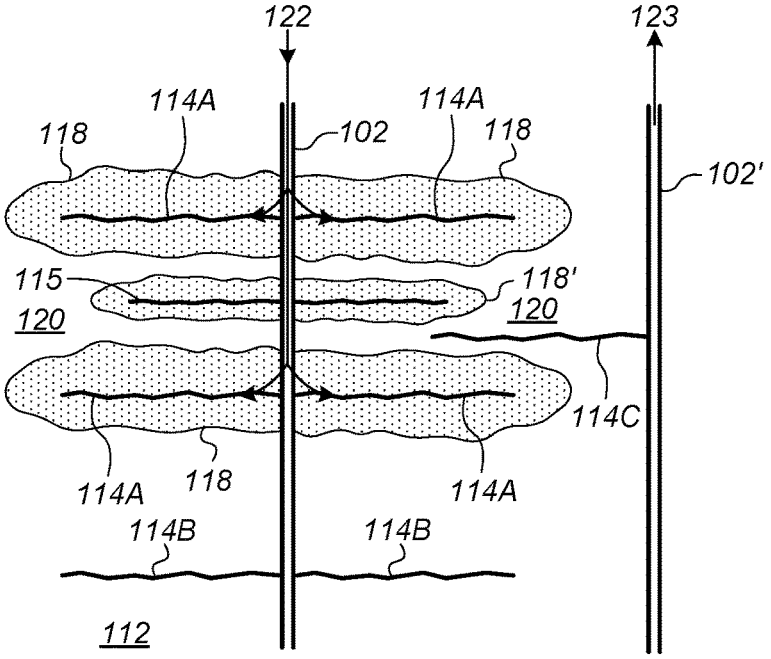

In certain embodiments, production of formation fluids 119 from wellbore 102 is stopped after a selected amount of time (e.g., after sufficient depletion of hydrocarbons from areas surrounding fractures 115) and second fluid 122 is provided into wellbore 102, as shown in FIGS. 7A and 7B. Formation fluids 123 may be produced from second wellbore 102'. As fractures 114C propagate into zones 120 and do not intersect with fractures 114A and/or fractures 115, fractures 114C provide access to additional formation that is not depleted of hydrocarbons (e.g., the areas around fractures 114A and fractures 115 already produced through wellbore 102).

In some embodiments, second fluid 122 is provided into wellbore 102 before producing formation fluids 123 from second wellbore 102'. In some embodiments, second fluid 122 is provided into wellbore 102 after producing formation fluids 123 from second wellbore 102'. In some embodiments, second fluid 122 is provided into wellbore 102 both before and after producing formation fluids 123 from second wellbore 102'. For example, injection of second fluid 122 may be cycled with production of formation fluids 123 through second wellbore 102'.

Second fluid 122 may be used to provide pressure support in formation 112 for production of formation fluids 123 through second wellbore 102'. In some embodiments, second fluid 122 is substantially the same as fluid 116 (shown in FIG. 3). In some embodiments, second fluid 122 is a different fluid from fluid 116 (e.g., fluid 122 has a different composition and/or different components than fluid 116). Fluid 122 may be water or mostly water. In some embodiments, fluid 122 is at least about 95% by weight water. In some embodiments, fluid 122 is at least about 90% by weight water or at least about 80% by weight water. In some embodiments, fluid 122 includes a gas or is a gas. For example, fluid 122 may include, or be, carbon dioxide and/or natural gas. In some embodiments, fluid 122 includes water and gas provided in an alternating water and gas process (e.g., a WAG process).

In some embodiments, fluid 122 includes one or more additives (e.g., in addition to water or gas). For example, fluid 122 may include anionic surfactant, cationic surfactant, zwitterionic surfactant, non-ionic surfactant, or combinations thereof. The additives in fluid 122 may reduce interfacial tension, alter wettability, increase sweep, vaporize condensate, and/or reduce oil viscosity to enhance flow production of formation fluids through second wellbore 102'. In some embodiments, fluid 122 includes a diverter material and/or a plugging agent. The diverter material and/or the plugging agent may be intermittently added to fluid 122.

Injection of second fluid 122 may be used to increase the production of formation fluids through second wellbore 102'. Because fractures 114A and fractures 115 overlap but do not intersect fractures 114C, the geometry of the fractures is suitable for injection of second fluid 122 (e.g., waterflood and/or gas flood) to enhance production through second wellbore 102' and injection of the second fluid occurs in a linear process. For example, the creation of zones 118, zones 118', and zones 120 create fractures 114A, 115, and 114C that may be substantially parallel but, more importantly, fractures that overlap without intersecting. Additionally, fractures 114A, 115, and 114C may overlap with distances between the fractures being shorter than the distance between wellbore 102 and second wellbore 102'.

Figure 8:
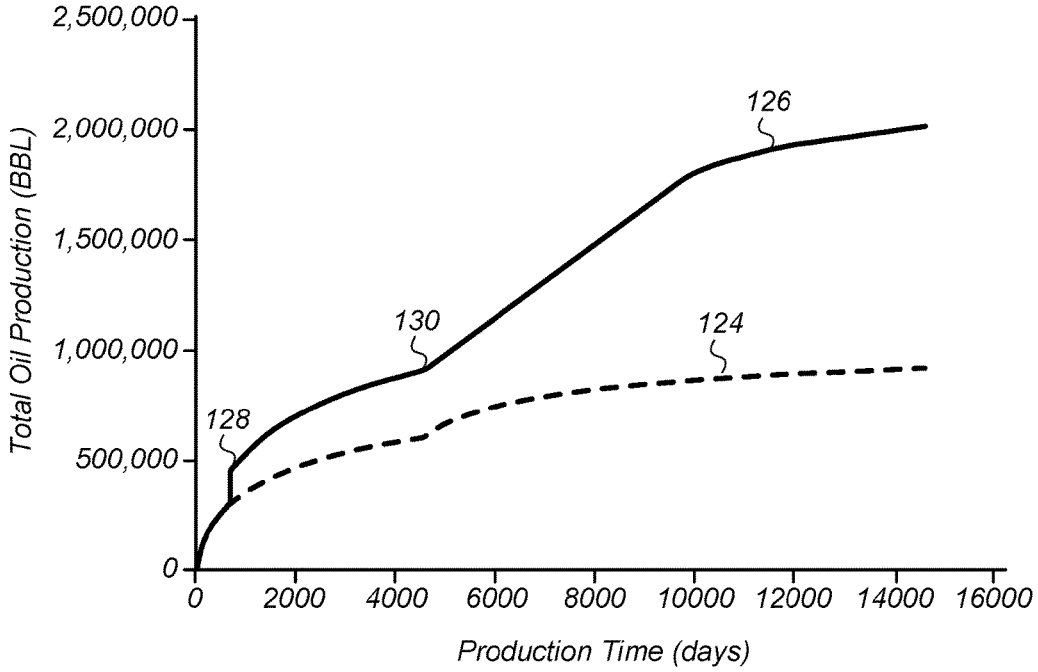
FIG. 8 depicts a comparison plot of total production using the process described herein versus a conventional fracturing and production process.

As shown above, the process of forming additional fractures 115, creating zones 118 and zones 118' around fractures 114A and fractures 115, respectively, along with zone 120 between zones 118 and zones 118', forming fractures 114C that propagate into zone 120 from second wellbore 102', producing formation fluids through wellbore 102, producing formation fluids through the second wellbore, and providing second fluid 122 through wellbore 102 increases the production of hydrocarbons from formation 112. FIG. 8 depicts a comparison plot of total production using the above-described process versus a conventional fracturing and production process. The curves in FIG. 8 were obtained using a reservoir simulation. Curve 124 is for a convention fracturing and production process. Curve 126 is for the above-described process involving fractures 115, zones 118, zones 118', zones 120, and fractures 114C.

As shown in FIG. 8, curves 124 and 126 are substantially identical during the primary recovery period (e.g., below about 1000 days). Thus, the conventional fracturing and production process and the process described herein have similar total oil production during such period. After such period, curve 124 shows that total oil production flattens out (e.g., oil production slows down) and there is little production after the primary recovery period. Using the process described herein, however, at point 128 along curve 126, the production rate increases after additional fractures 115 are formed in formation 112 with fractures 115 increasing access to hydrocarbons in the formation. At point 130 along curve 126, the production rate increases again after second fluid 122 is provided into wellbore 102 and formation fluids 123 are produced from second wellbore 102'. As shown by the differences between curve 124 and curve 126, total oil production using the process described herein is substantially increased compared to total oil production using the conventional fracturing and production process (e.g., total oil production using the process described herein is more than twice the total oil production using the conventional fracturing process after about 14000 days).

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A method of treating a subsurface formation, comprising:

providing a first fluid into a first wellbore, a first fracture and a second fracture emanating from the first wellbore into the formation, at least some hydrocarbons having been produced from the formation through the first fracture and the second fracture and through the first wellbore;

wherein at least a portion of the first fluid is provided at a pressure above a fracture pressure of the subsurface formation for at least a period of time to form one or more third fractures;

wherein at least a portion of the first fluid increases a minimum horizontal stress in a first zone of the formation substantially surrounding the first fracture, wherein at least a portion of the first fluid increases a minimum horizontal stress in a second zone substantially surrounding the second fracture, and wherein at least a portion of the first fluid increases a minimum horizontal stress in a third zone of the formation substantially surrounding at least one of the third fractures;

wherein a fourth zone of the formation is located outside of the first zone, the second zone, and the third zone, and wherein the fourth zone has a minimum horizontal stress below the minimum horizontal stress in the first zone, the minimum horizontal stress in the second zone, and the minimum horizontal stress in the third zone after the first fluid increases the minimum horizontal stresses in the first zone, the second zone, and the third zone;

forming one or more fourth fractures emanating from a second wellbore in the formation, wherein the second wellbore is substantially parallel to the first wellbore, wherein at least one of the fourth fractures emanates from the second wellbore and propagates into the fourth zone of the formation, and wherein the fourth fractures do not intersect with the fractures emanating from the first wellbore;

producing hydrocarbons from the first wellbore;

providing a second fluid into the first wellbore after producing at least some hydrocarbons from the first wellbore; and producing hydrocarbons from the second wellbore after forming the fourth fractures.

2. The method of claim 1, further comprising producing hydrocarbons from the second wellbore after providing the second fluid into the first wellbore.

3. The method of claim 1, wherein at least one of the third fractures extends towards the second wellbore from the first fracture or the second fracture.

4. The method of claim 1, wherein at least one of the third fractures extends towards the second wellbore from a new initiation port from the first wellbore, and wherein the at least one third fracture does not intersect with the first fracture or the second fracture.

5. The method of claim 1, wherein at least some of the hydrocarbons produced from the second wellbore comprise hydrocarbons produced through at least one of the fourth fractures.

6. The method of claim 1, wherein the first wellbore comprises a substantially horizontal wellbore in the formation.

7. The method of claim 1, wherein the first wellbore is positioned in a portion of the subsurface formation with an average matrix permeability of at most about 1 mD.

8. The method of claim 1, further comprising adding proppant to the first fluid for at least some of the period of time when at least the portion of the first fluid is provided at the pressure above the fracture pressure of the subsurface formation.

9. The method of claim 1, wherein the first fluid comprises at least about 95% by weight water.

10. The method of claim 1, wherein the first fluid comprises carbon dioxide, natural gas, or a combination thereof.

11. The method of claim 1, further comprising intermittently adding diverter material or plugging agent to the first fluid.

12. The method of claim 1, wherein the second fluid comprises at least about 95% by weight water.

13. The method of claim 12, wherein the second fluid further comprises anionic surfactant, cationic surfactant, zwitterionic surfactant, non-ionic surfactant, or combinations thereof.

14. The method of claim 1, wherein the second fluid comprises carbon dioxide, natural gas, or a combination thereof.

15. The method of claim 1, wherein at least the portion of the first fluid provided at the pressure above the fracture pressure of the formation comprises at least about 25% by weight of a total injection volume of the first fluid.

16. A method of treating a subsurface formation, comprising:

providing a first fluid into a first wellbore, a first fracture and a second fracture emanating from the first wellbore into the formation, at least some hydrocarbons having been produced from the formation through the first fracture and the second fracture and through the first wellbore, wherein at least 25% by weight of the first fluid is provided at a pressure above a fracture pressure of the subsurface formation for a selected period of time to form a third fracture in the formation;

wherein at least a portion of the first fluid increases a minimum horizontal stress in a first volume of the formation substantially surrounding the first fracture, wherein at least a portion of the first fluid increases a minimum horizontal stress in a second volume of the formation substantially surrounding the second fracture, and wherein at least a portion of the first fluid increases a minimum horizontal stress in a third volume of the formation substantially surrounding the third fracture;

wherein a fourth volume of the formation is located outside of the first volume, the second volume, and the third volume, and wherein the fourth volume has a minimum horizontal stress below the minimum horizontal stress in the first volume, the minimum horizontal stress in the second volume, and the minimum horizontal stress in the third volume after the first fluid is provided into the first wellbore;

forming one or more fourth fractures emanating from a second wellbore in the formation, wherein the second wellbore is substantially parallel to the first wellbore, and wherein at least one of the fourth fractures emanates from the second wellbore and propagates into the fourth volume of the formation;

producing hydrocarbons from the first wellbore;

providing a second fluid into the first wellbore after producing at least some hydrocarbons from the first wellbore; and producing hydrocarbons from the second wellbore after forming the fourth fractures.

17. The method of claim 16, further comprising adding proppant to the first fluid when the pressure of at least the portion of the first fluid is increased.

18. The method of claim 16, wherein the first wellbore comprises a substantially horizontal wellbore in the formation.

19. The method of claim 16, wherein the first wellbore is positioned in a portion of the subsurface formation with an average matrix permeability of at most about 1 mD.

20. The method of claim 16, wherein the first fluid comprises at least about 95% by weight water.

21. The method of claim 16, wherein the first fluid comprises carbon dioxide, and/or natural gas, or a combination thereof.

22. The method of claim 16, wherein the second fluid comprises at least about 95% by weight water.

23. The method of claim 22, wherein the second fluid further comprises anionic surfactant, cationic surfactant, zwitterionic surfactant, non-ionic surfactant, or combinations thereof.

24. The method of claim 16, wherein the second fluid comprises carbon dioxide, natural gas, or a combination thereof.

* * * * *